US008802961B2

(12) United States Patent
Juszkiewicz

(10) Patent No.: US 8,802,961 B2
(45) Date of Patent: Aug. 12, 2014

(54) WIRELESS FOOT-OPERATED EFFECTS PEDAL FOR ELECTRIC STRINGED MUSICAL INSTRUMENT

(75) Inventor: Henry E. Juszkiewicz, Nashville, TN (US)

(73) Assignee: Gibson Brands, Inc., Nashville, TN (US)

( * ) Notice: Subject to any disclaimer, the term of this patent is extended or adjusted under 35 U.S.C. 154(b) by 0 days.

(21) Appl. No.: 13/882,175

(22) PCT Filed: Oct. 28, 2011

(86) PCT No.: PCT/US2011/058473

§ 371 (c)(1), (2), (4) Date: Aug. 1, 2013

(87) PCT Pub. No.: WO2012/058646

PCT Pub. Date: May 3, 2012

(65) Prior Publication Data

US 2013/0298752 A1 Nov. 14, 2013

Related U.S. Application Data

(60) Provisional application No. 61/407,897, filed on Oct. 28, 2010.

(51) Int. Cl.
*G10H 1/32* (2006.01)
*G10H 3/00* (2006.01)

(52) U.S. Cl.
USPC ..... 84/746

(58) Field of Classification Search
USPC ..... 84/721, 746, 744, 225, 426
See application file for complete search history.

(56) References Cited

U.S. PATENT DOCUMENTS

| | | | | |
|---|---|---|---|---|
| 5,131,306 | A * | 7/1992 | Yamamoto | 84/19 |
| 5,429,092 | A * | 7/1995 | Kamei | 123/399 |
| 5,866,829 | A * | 2/1999 | Pecoraro | 84/177 |
| 5,878,359 | A * | 3/1999 | Takeda | 701/29.2 |
| 6,215,055 | B1 * | 4/2001 | Saravis | 84/422.1 |
| 7,157,640 | B2 * | 1/2007 | Baggs | 84/731 |
| 7,326,849 | B2 * | 2/2008 | Adams et al. | 84/746 |
| 7,332,670 | B2 * | 2/2008 | Fujiwara et al. | 84/744 |
| 7,476,799 | B2 * | 1/2009 | Purchon et al. | 84/746 |
| 7,608,776 | B2 * | 10/2009 | Ludwig | 84/721 |
| 7,754,956 | B2 * | 7/2010 | Gain et al. | 84/615 |
| 8,509,692 | B2 * | 8/2013 | Ryle et al. | 455/41.3 |
| 2004/0016338 | A1 * | 1/2004 | Dobies | 84/662 |
| 2007/0234888 | A1 * | 10/2007 | Rotolo de Moraes | 84/730 |
| 2008/0127808 | A1 * | 6/2008 | Shaffer | 84/464 A |
| 2009/0183625 | A1 * | 7/2009 | Sanders | 84/626 |
| 2010/0269670 | A1 * | 10/2010 | O'Connor et al. | 84/626 |
| 2011/0088536 | A1 * | 4/2011 | McMillen et al. | 84/746 |
| 2011/0271821 | A1 * | 11/2011 | McKinney et al. | 84/746 |
| 2011/0303077 | A1 * | 12/2011 | Vinciguerra | 84/746 |
| 2013/0118340 | A1 * | 5/2013 | D'Amours | 84/746 |

* cited by examiner

*Primary Examiner* — Jeffrey Donels
(74) *Attorney, Agent, or Firm* — Bates & Bates, LLC

(57) ABSTRACT

A footswitch controller for an electric stringed musical instrument is provided. In one embodiment, the footswitch controller comprises a foot pedal assembly, base assembly, bottom plate assembly, battery pocket assembly, and compound assembly. The footswitch controller does not directly alter the input sound, but upon activation by a user sends a signal to the digital signal processor within the electric stringed musical instrument to alter the sound.

20 Claims, 26 Drawing Sheets

| Switch Mode | 1 Direct Bank Access | 1 (stomp twice) User Patch Access | 3 Patch Select | 3(stomp twice) PickUp Select | 1 & 2 Effects Control | 2 & 3 Tuning Select |
|---|---|---|---|---|---|---|
| 4 | 1 | 1 | O - - - - [Sw 1] | O - - - - [Sw 1] | Comp (on/off) | E A D G B e |
| 5 | 2 | 2 | - O - - - [Sw 2] | - O - - - [Sw 2] | Dist (on/off) | D A D G B e |
| 6 | 3 | 3 | - - O - - [Sw 3] | - - O - - [Sw 3] | EQ (on/off) | D A D G B D |
| 7 | 4 | 4 | - - - O - [Sw 4] | - - - O - [Sw 4] | Tape Mod (on/off) | E B E G# B e |
| 8 | 5 | 5 | - - - - O [Sw 5] | - - - - O [Sw 5] | Tape Echo (on/off) | E A E A C# e |
| 9 | 6 | 6 | Tap Tempo | PU Comb 6 | Tape Reverb (on/off) | Db Ab Db Gb Bb Eb |
| 4 & 7 | 7 | 7 | Distort (on/off) | PU Comb 7 | Tone Bal. (on/off) | D G D G B D |
| 5 & 8 | 8 | 8 | Tape (on/off) | PU Comb 8 | Tone Bal. capture | Eb Ab Db Gb Bb eb |
| 6 & 9 | 9 | 9 | Lead Vol (on/off) | PU Comb 9 | Live Edit (on/off) | E B E G B e |
| 5 & 6 | 10 | 10 | Patch Back | PU Comb 10 | Mute All | D G C F A D |
| 8 & 9 | 11 | 11 | Patch Forward | PU Comb 11 | Un Mute All | Check Tuning |

FIG. 10

WIRELESS FOOT-OPERATED EFFECTS PEDAL FOR ELECTRIC STRINGED MUSICAL INSTRUMENT

CROSS-REFERENCE TO RELATED APPLICATION

This Application claims priority to U.S. Provisional Patent application Ser. No. 61/407,897, filed Oct. 28, 2010, and PCT Patent Application No. PCT/US2011/058473, filed Oct. 28, 2011, both of which are hereby incorporated by reference in their entirety.

TECHNICAL FIELD

The field of the disclosure relates generally to the construction of wireless effect pedals for electric stringed musical instruments. More particularly, the disclosure relates to the construction of foot operated wireless effect pedals wherein the foot operated wireless effect pedal does not directly vary the properties of signal input.

BACKGROUND

The use of sound effects by musicians is quite popular, especially with guitar players. Examples of the types of sound effects that can be generated include distortion, fuzz, overdrive, chorus, reverberation, wah-wah, flanging, phaser or pitch shifting. Historically, these sound effects were generated by sound effect generators or more broadly as signal processing/altering devices or audio components. These devices are also commonly called effects pedals or stomp boxes.

Some sound effect pedals are manipulated while the musician is playing by rocking a large treadle potentiometer back and forth, thus the relative position of the "pedal" determines the extension to which the sound is altered. In other sound effect pedals, the musician simply presses a switch or turns a knob to get the desired sound. Once activated, through one of the above methods, these sound effects pedals can process the signal through digital or analog means. However, in known sound effects pedals, the sound effects pedal internally varies the input signal to produce an effected output.

SUMMARY

In an example embodiment, a footswitch controller for an electric stringed musical instrument system is provided. The footswitch controller includes, but is not limited to, a foot pedal assembly, a base assembly, a bottom plate assembly and a compound assembly. The foot pedal assembly can include a damper, a silencer, and/or at least one bump stop. In one embodiment, the foot pedal assembly comprises at least one fastener opening such that the foot pedal can be reversibly connected with the base assembly.

In another example embodiment, each footswitch controller has an unique identification which allows multiple footswitch controllers to be used with a single electric stringed musical instrument system.

In yet another example embodiment, a method of pairing the disclosed footswitch controller to an electric stringed musical instrument is described. In the method, using the footswitch controller, an inquiry is automatically initiated to find an electric stringed musical instrument. An address is then transmitted from the electric stringed musical instrument to the footswitch controller and a paging procedure is executed to synchronize the footswitch controller with the electric stringed musical instrument.

Other principal features and advantages of the invention will become apparent to those skilled in the art upon review of the following drawings, the detailed description, and the appended claims.

BRIEF DESCRIPTION OF THE DRAWINGS

Illustrative embodiments of the invention will hereafter be described with reference to the accompanying drawings, wherein like numerals denote like elements.

FIG. 10 is a table demonstrating exemplary use of number footswitch controller. In this embodiment, switches 1-3 are across the top left to right, switches 4-6 are along the left side and switches 7-9 are along the right side of the switchboard.

DETAILED DESCRIPTION

Before describing the exemplary embodiments in detail, it is to be understood that the embodiments are not limited to particular apparatuses or methods, as the apparatuses and methods can, of course, vary. It is also to be understood that the terminology used herein is for the purpose of describing particular embodiments only, and is not intended to be limiting. Unless defined otherwise, all technical and scientific terms used herein have the same meaning as commonly understood by one of ordinary skill in the art to which an embodiment pertains. Many methods and materials similar, modified, or equivalent to those described herein can be used in the practice of the current embodiments without undue experimentation.

As used in this specification and the appended claims, the singular forms "a", "an" and "the" can include plural referents unless the content clearly indicates otherwise. Thus, for example, reference to "a component" can include a combination of two or more components.

Figure 1:
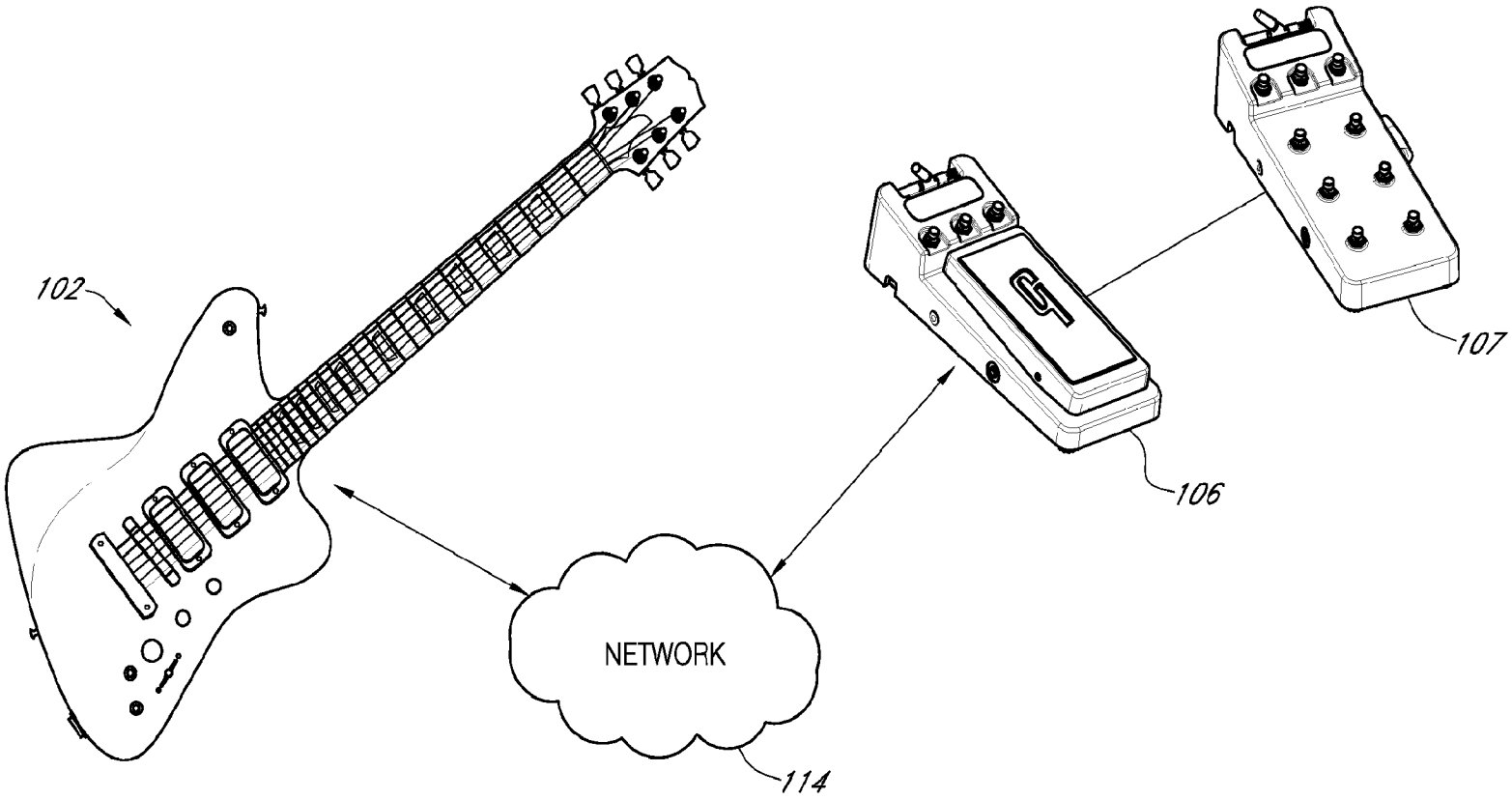
FIG. 1 depicts the interaction of an electric stringed musical instrument with the disclosed footswitch controllers.

Exemplary embodiments of the footswitch controller will now be explained with reference to the figures. This description is provided in order to assist in the understanding of the invention and is not intended to limit the scope of the invention to the embodiments shown in the figures or described below. FIG. 1 demonstrates an exemplary embodiment of disclosed footswitch controllers 106 and 107 with an electric stringed musical instrument 102, which is a guitar in the embodiment of FIG. 1. In the embodiment of FIG. 1, two standard control pedals 106/107 are packaged with the electric stringed musical instrument 102. Each footswitch controller comprises a unique ID such that multiple footswitch controllers can be used, and thus mapped to an infinite number of functions. As used herein effects pedal and footswitch controller are interchangeable.

Figure 2A:
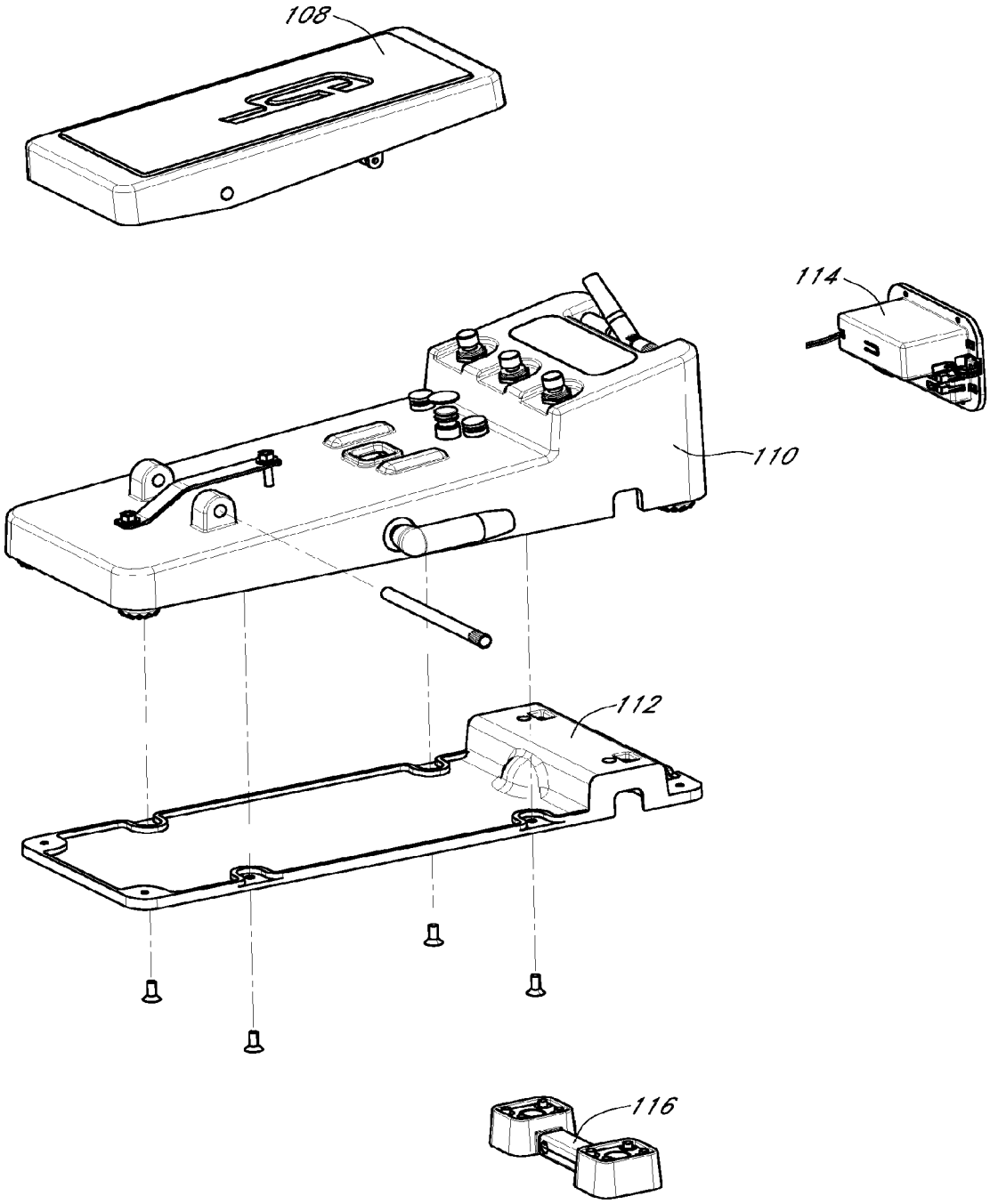
FIG. 2 illustrates a continuous controller footswitch controller.
Figure 2B:
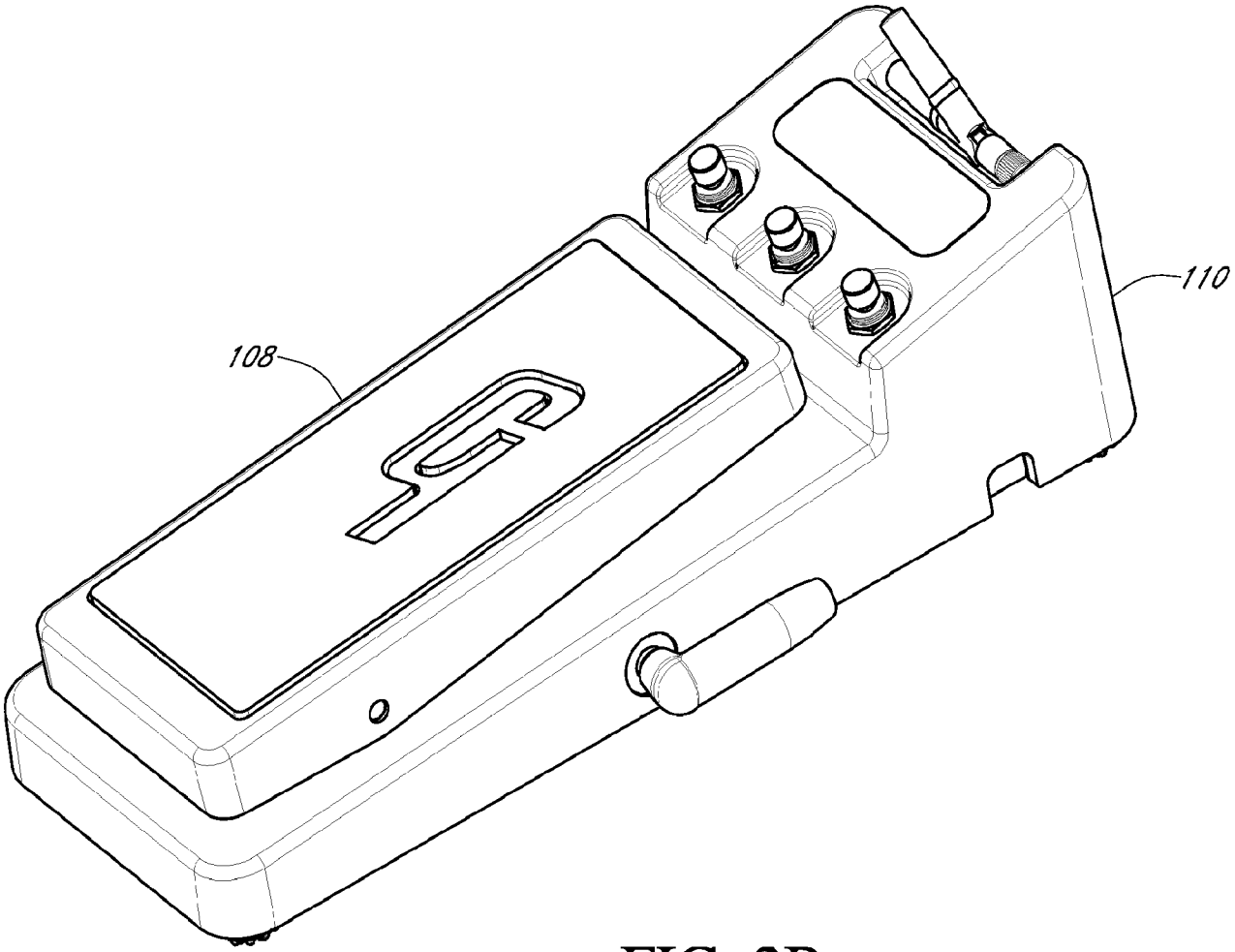
Figure 2C:
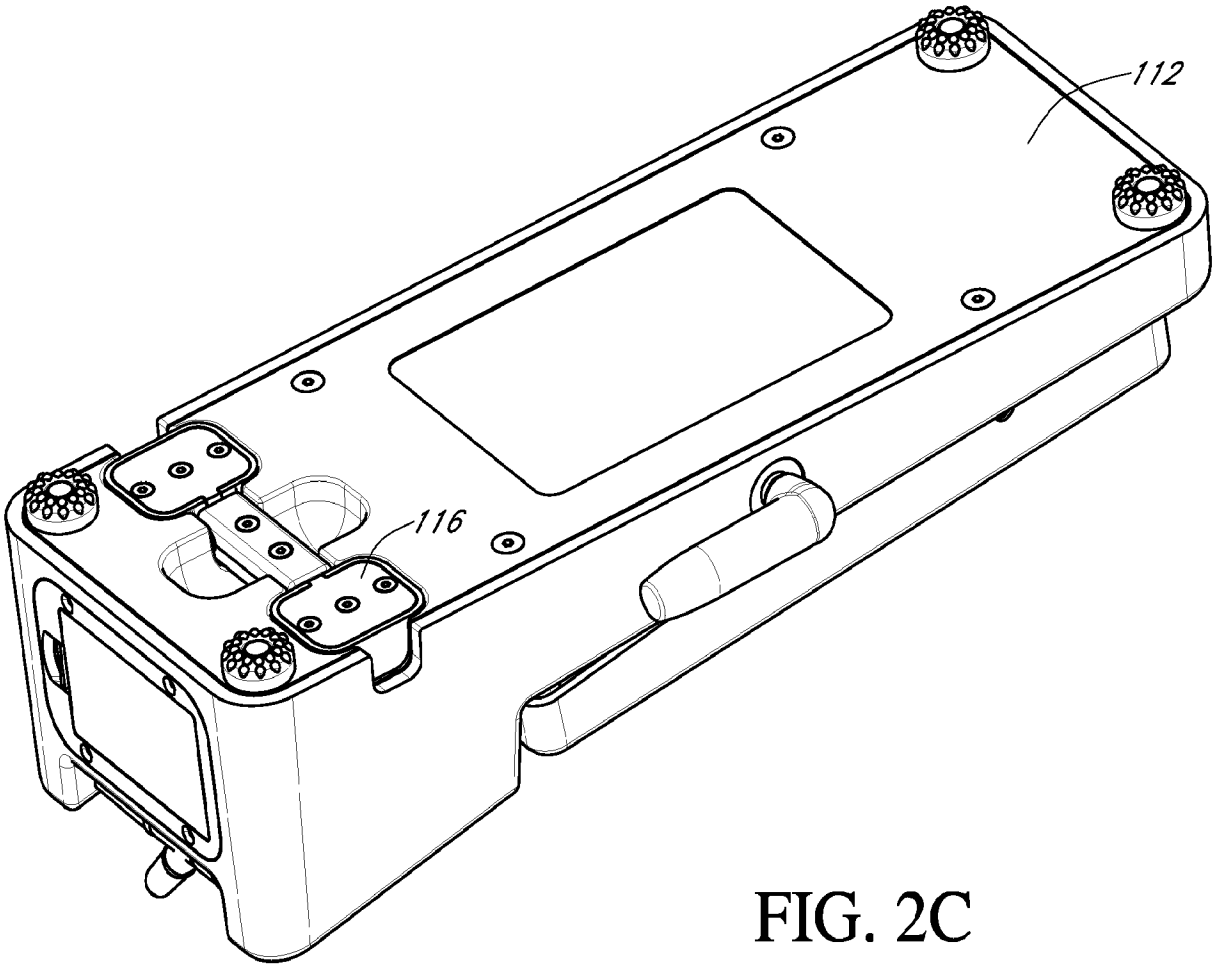
Figure 3A:
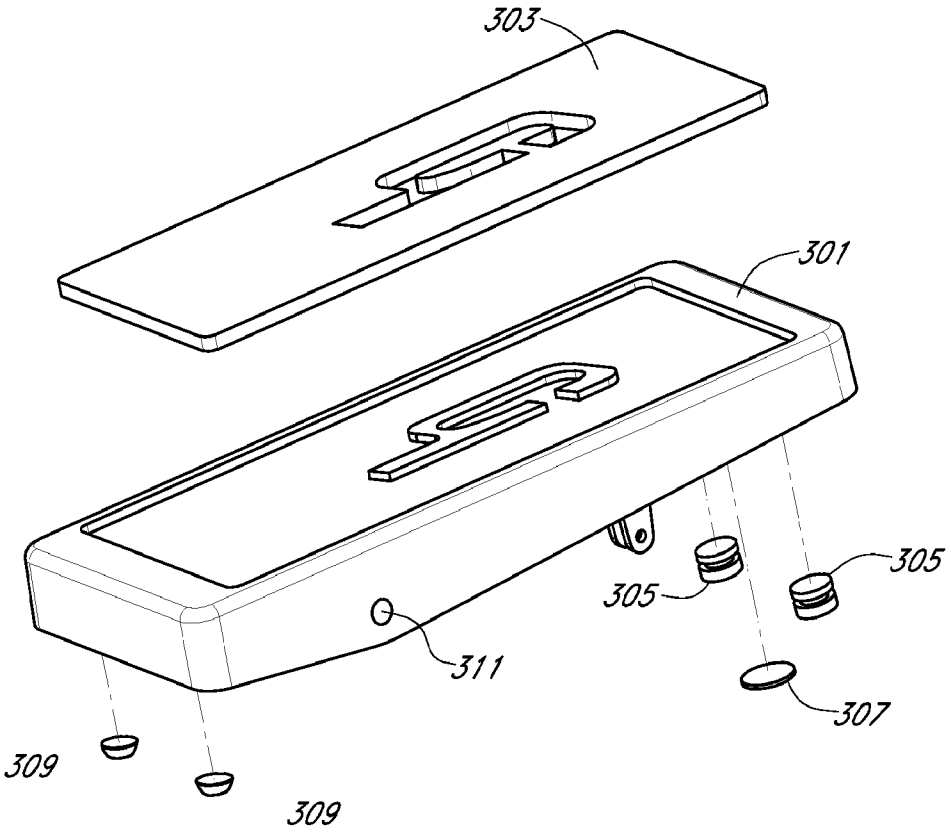
FIG. 3 demonstrates a foot pedal assembly of an exemplary continuous controller footswitch controller.
Figure 3B:
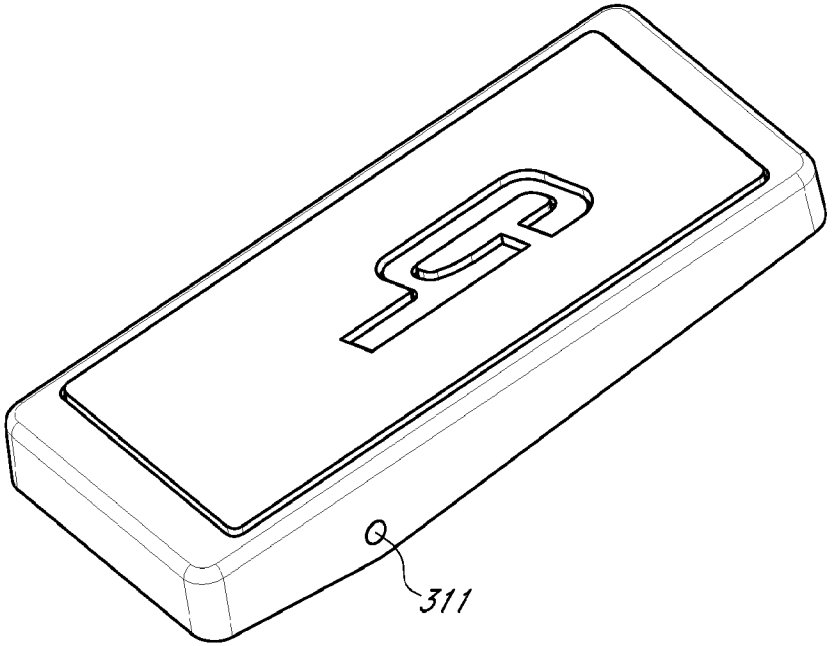
Figure 3C:
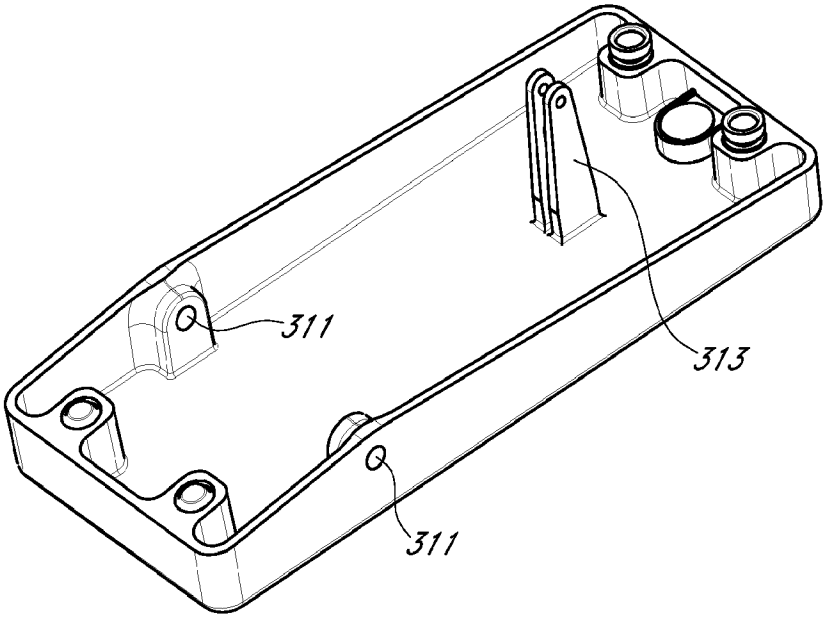

An embodiment of continuous controller footswitch controller 106 is illustrated in FIG. 2. Continuous controller footswitch controller includes foot pedal assembly 108, base assembly 110, bottom plate assembly 112, battery pocket assembly 114, and compound assembly 116. As demonstrated in FIG. 3, continuous controller footswitch controller foot pedal assembly 108 includes foot pedal 301, liner 303, at least one damper 305, silencer 307, and at least one bump stop 309. In one embodiment, both foot pedal 301 and liner 303 include a stylized G either cutout or embossed on their top surface. Additionally, foot pedal 301 comprises two openings 311 adapted for receiving a fastener such that foot pedal 301 can be connected with base assembly 110. Foot pedal 301 also includes projection sleeve 313, wherein projection sleeve 313 is adapted for connection of foot pedal 301 to a motor contained in base assembly 110. Housing 315 for damper 305, housing 317 for silencer 307, and housing 319 for bump stop 309 are additionally demonstrated in the embodiment of foot pedal assembly shown in FIG. 3.

Figure 4A:
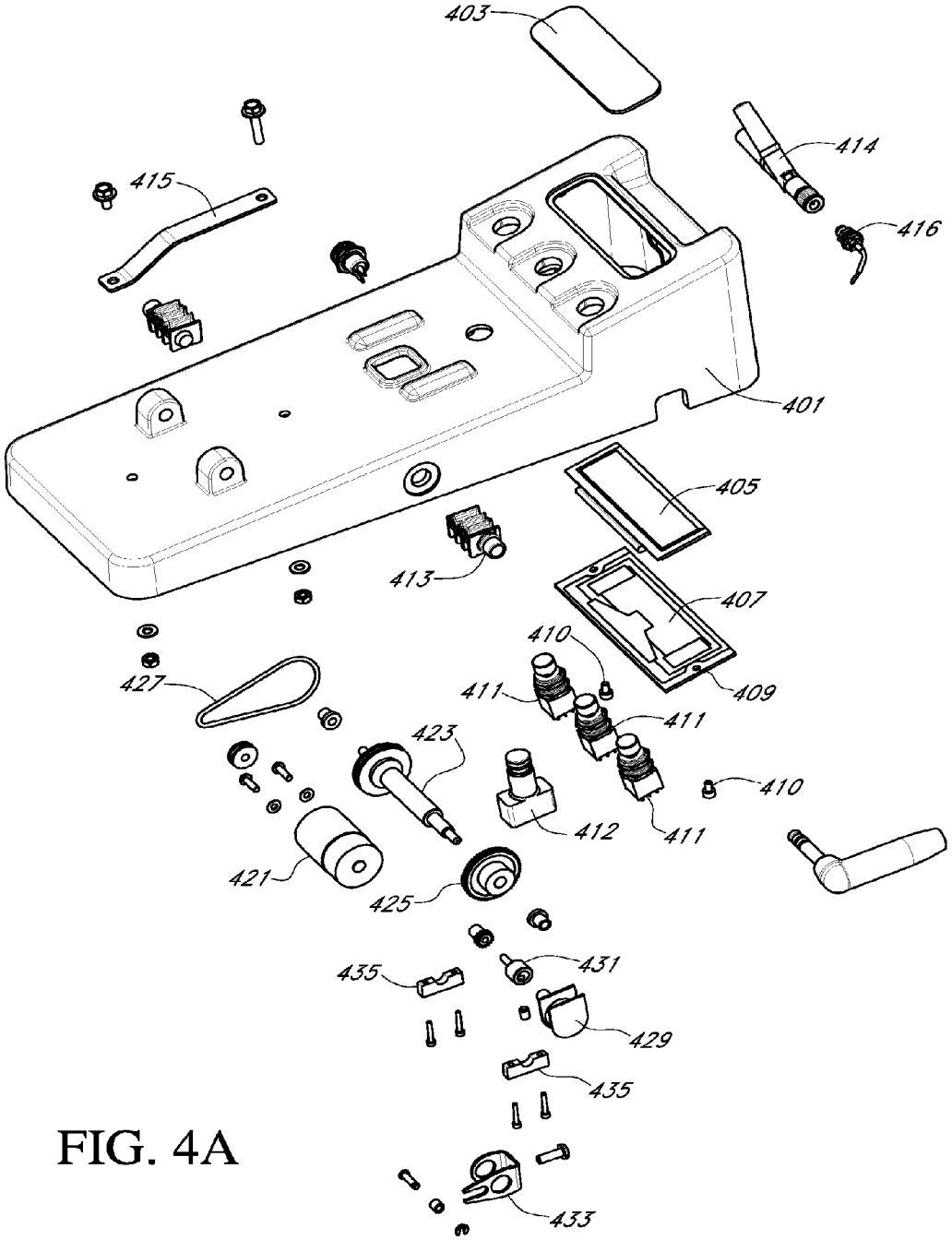
FIG. 4 is a base assembly of a continuous controller footswitch controller.
Figure 4B:
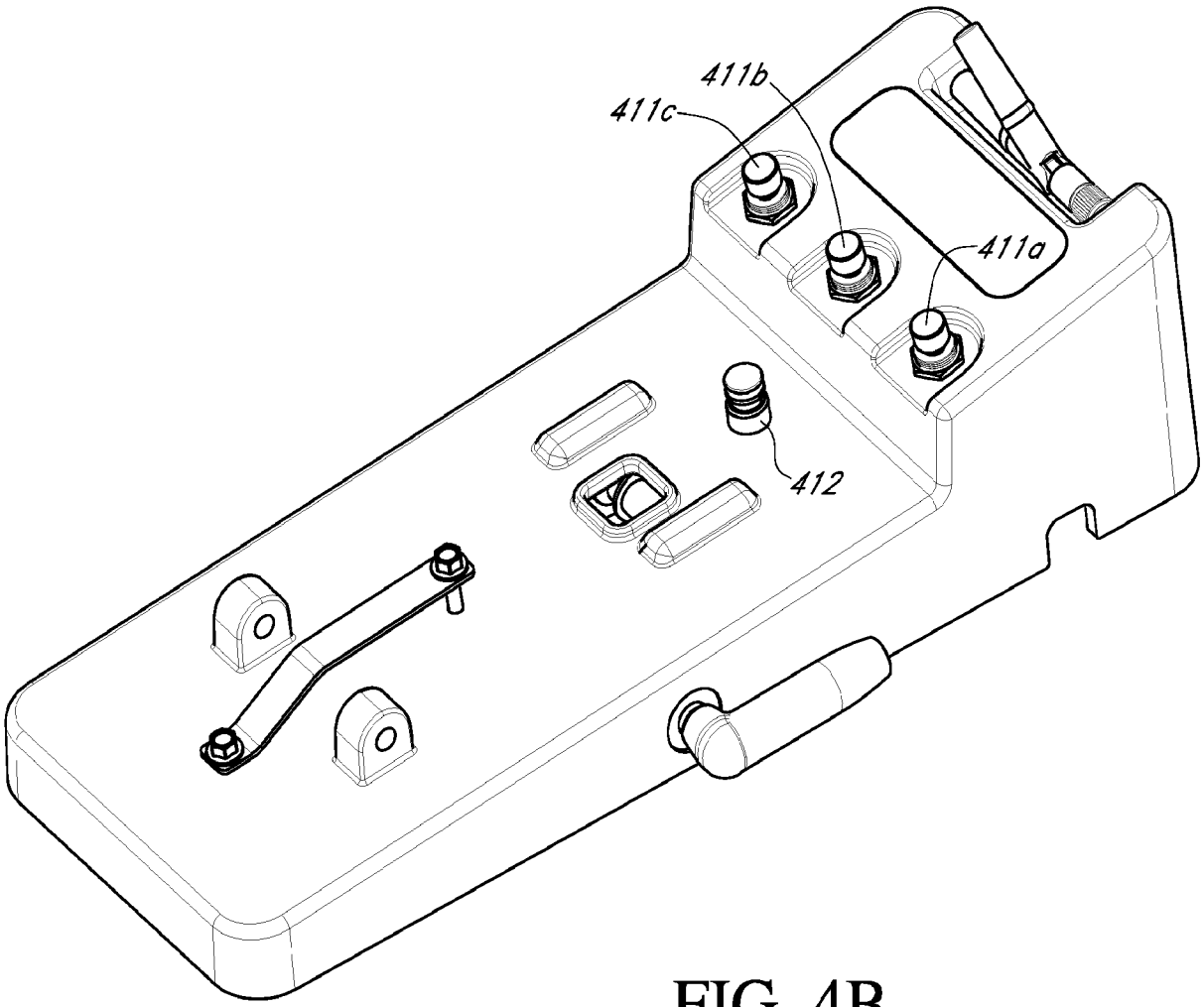
Figure 4C:
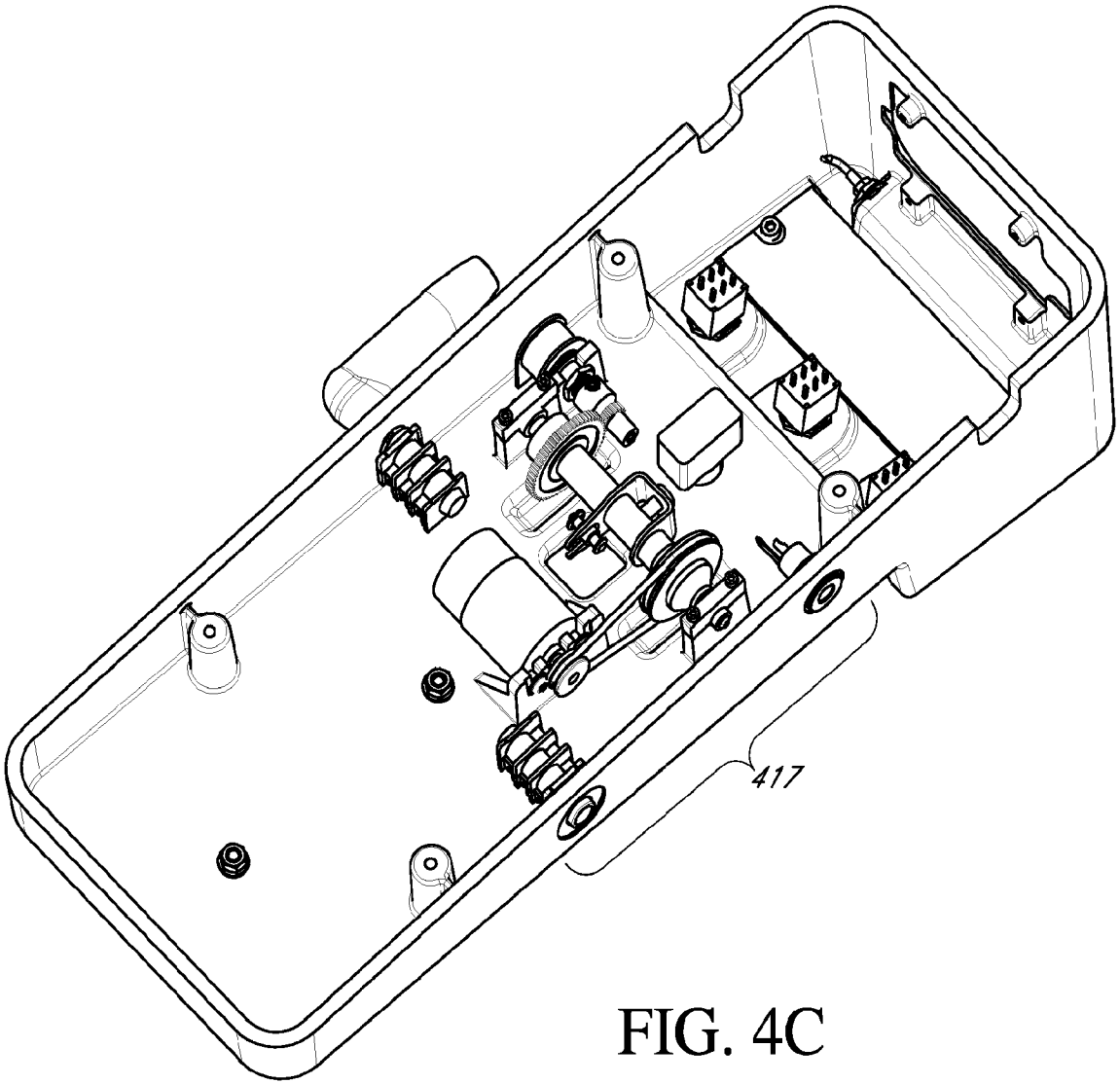

Base assembly 110 is embodied in FIG. 4. Continuous controller footswitch controller 106 is motorized. When a sound setting, i.e. patch, changes the controlled parameter, continuous controller footswitch controller moves to a preset position. Base assembly 110 includes foot pedal base 401, display panel 403, display LED 405, display LED PCB 407, at least one foot switch 411, switch 412, jack plug 413, bracket 415, antenna 414, antenna connector 416 and motor assembly 417. Display panel 403, display LED 405 and display LED PCB 407 together form display 400, connected together through openings 409 in display LED PCB 407 and fastener 410. Motor assembly 417 comprises motor 421, actuator shaft 423, wheel 425, belt 427, potentiometer 429, shaft 431, actuator 433, and bearing blocks 435. In the embodiment of FIG. 4, motor 421 is a DC motor; nevertheless, other appropriate motors are contemplated.

Figure 5A:
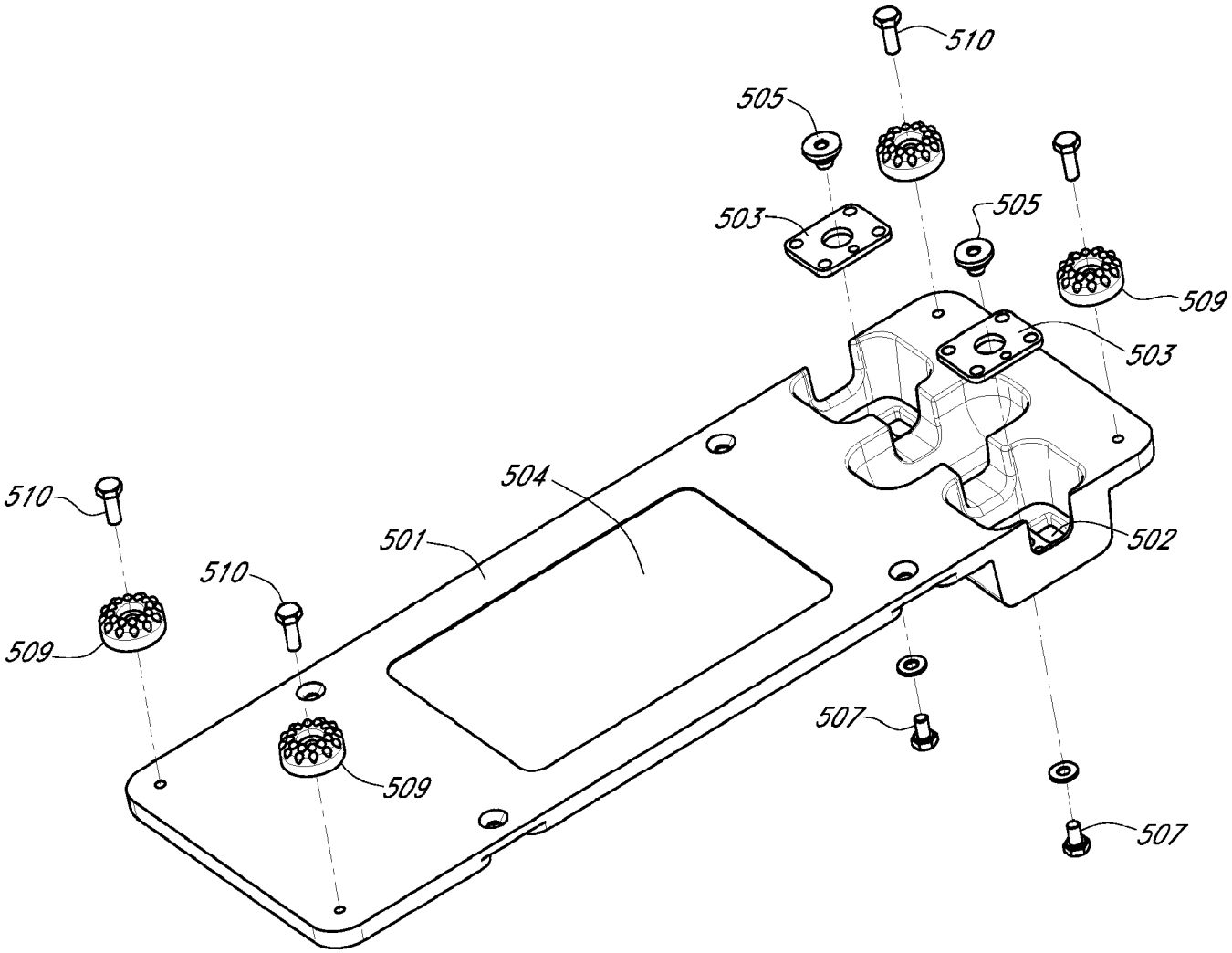
FIG. 5 demonstrates a bottom plate assembly of a footswitch controller.
Figure 5B:
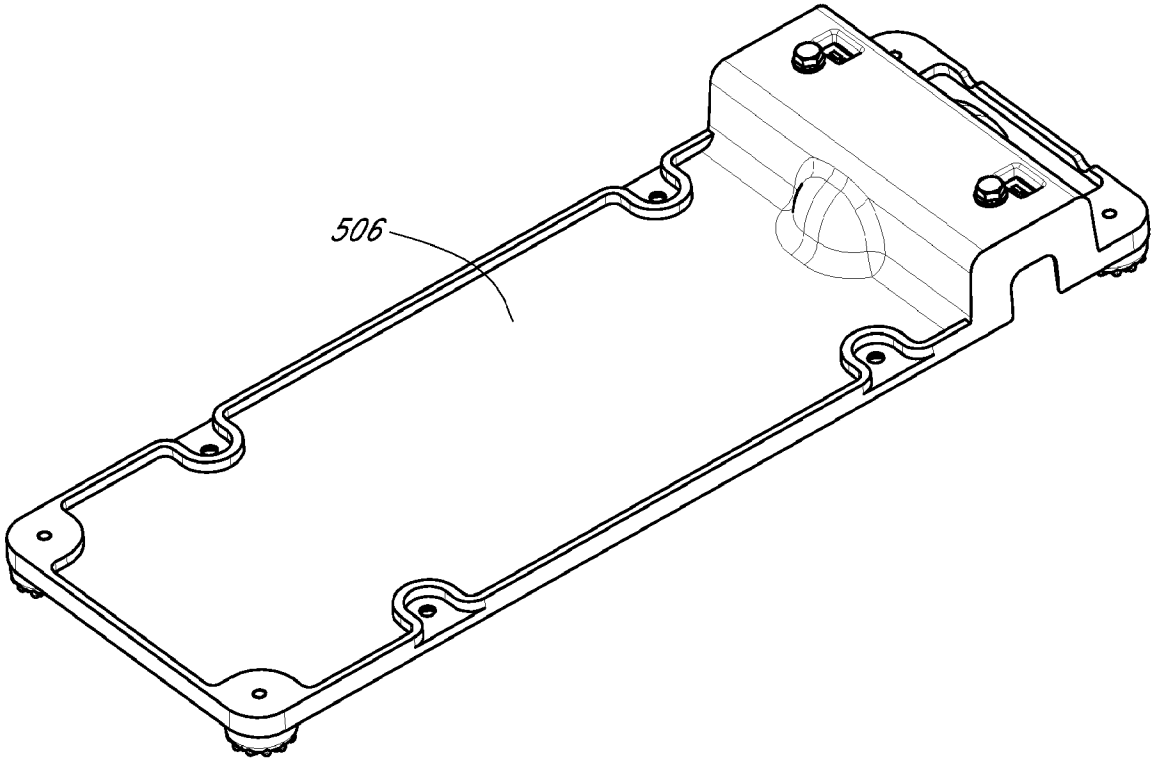
Figure 5C:
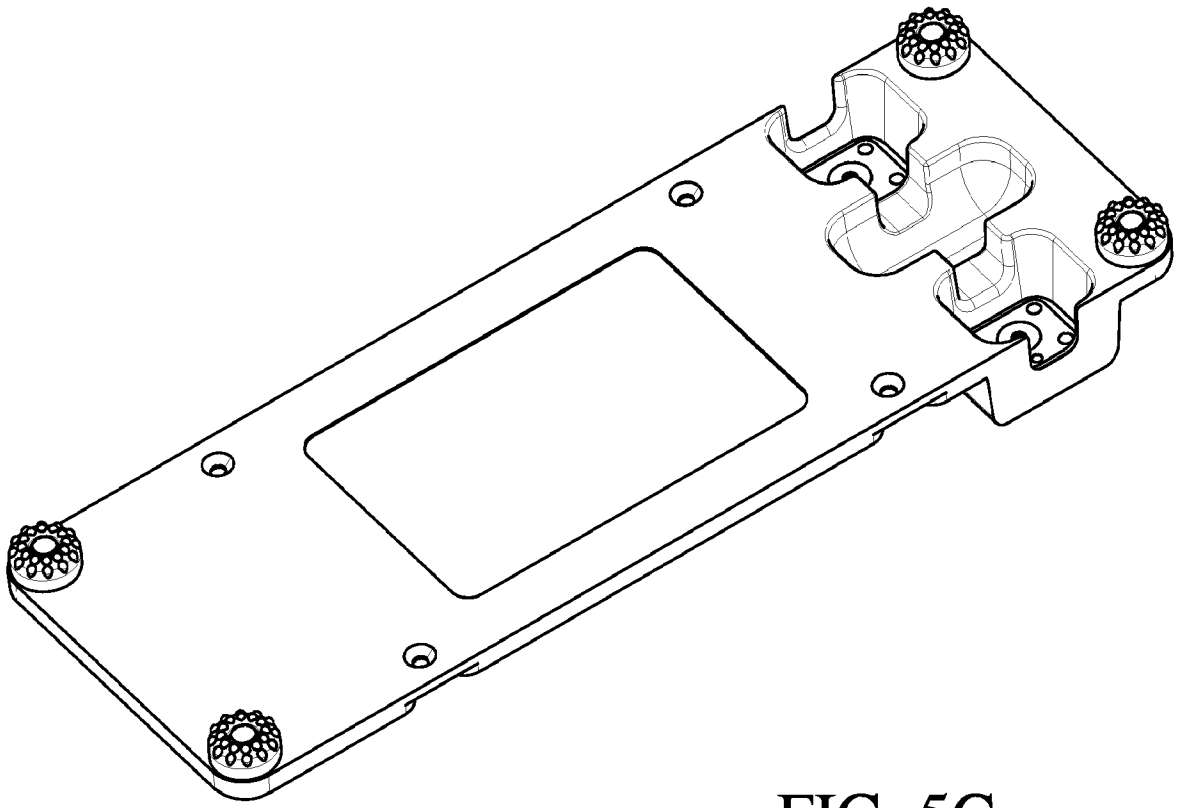

FIG. 5 shows bottom plate assembly 112. Bottom plate assembly 112 includes bottom plate 501, with bottom 504 and top 506, at least one cavity 502, compound PCB 503, holding disc 505, fastener 507, at least one foot 509, and fastener 510. Compound PCB 503 fits into cavity 502 and is held in place by holding disc 505 and fastener 507. Fastener 510 fastens foot 509 to bottom 504 of bottom plate 501 through openings 511 in bottom plate 501.

Figure 6A:
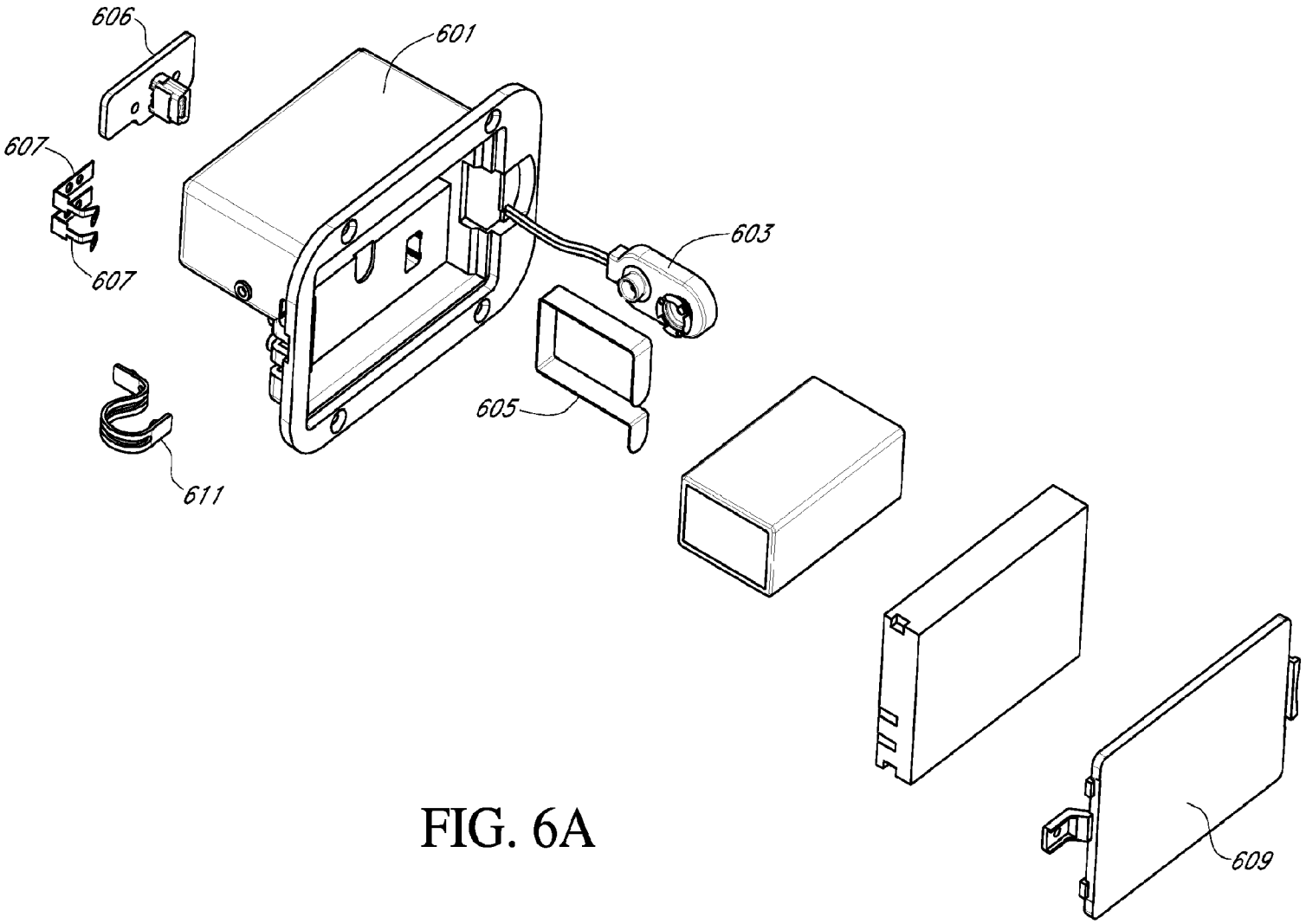
FIG. 6 illustrates a battery pocket assembly of a footswitch controller.
Figure 6B:
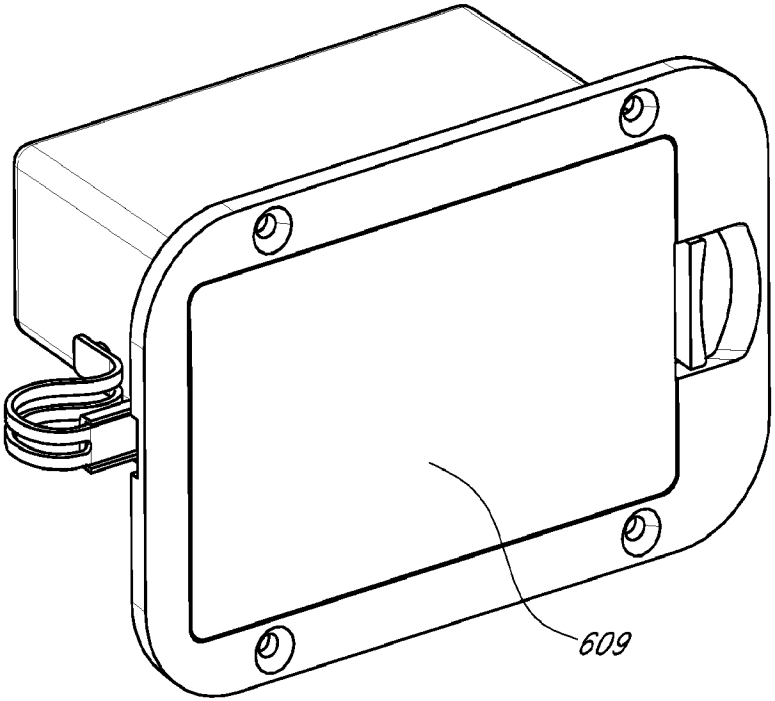
Figure 6C:
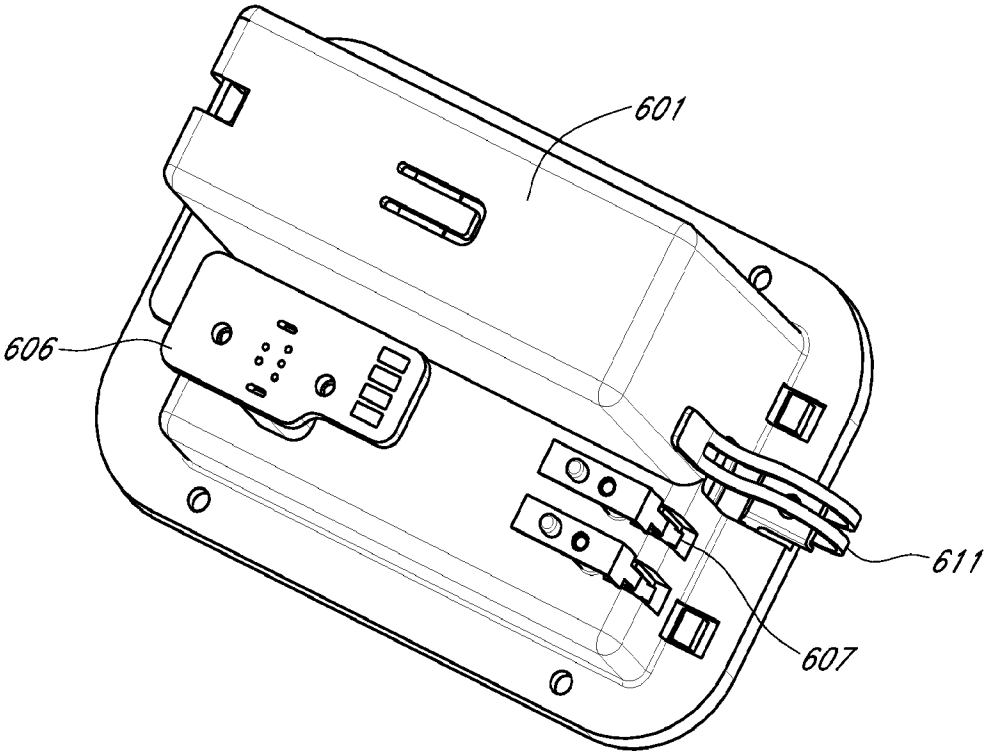

Referring to FIG. 6, battery pocket assembly 114, comprises battery pocket 601, block connector 603 connected with battery pocket 601, block strip 605, mini PCB 606, battery contact 607, cover 609 and cover tether 611. A battery 613 and block 615 are additionally demonstrated in FIG. 6 although as understood by the skilled artisan, battery 613 and block 615 are exchangeable and do not form parts of battery pocket assembly 114. Footswitch controllers use standard batteries for power. In many embodiments, the batteries are rechargeable lithium ion batteries and may be the same batteries used with the electric stringed musical instrument.

Figure 7A:
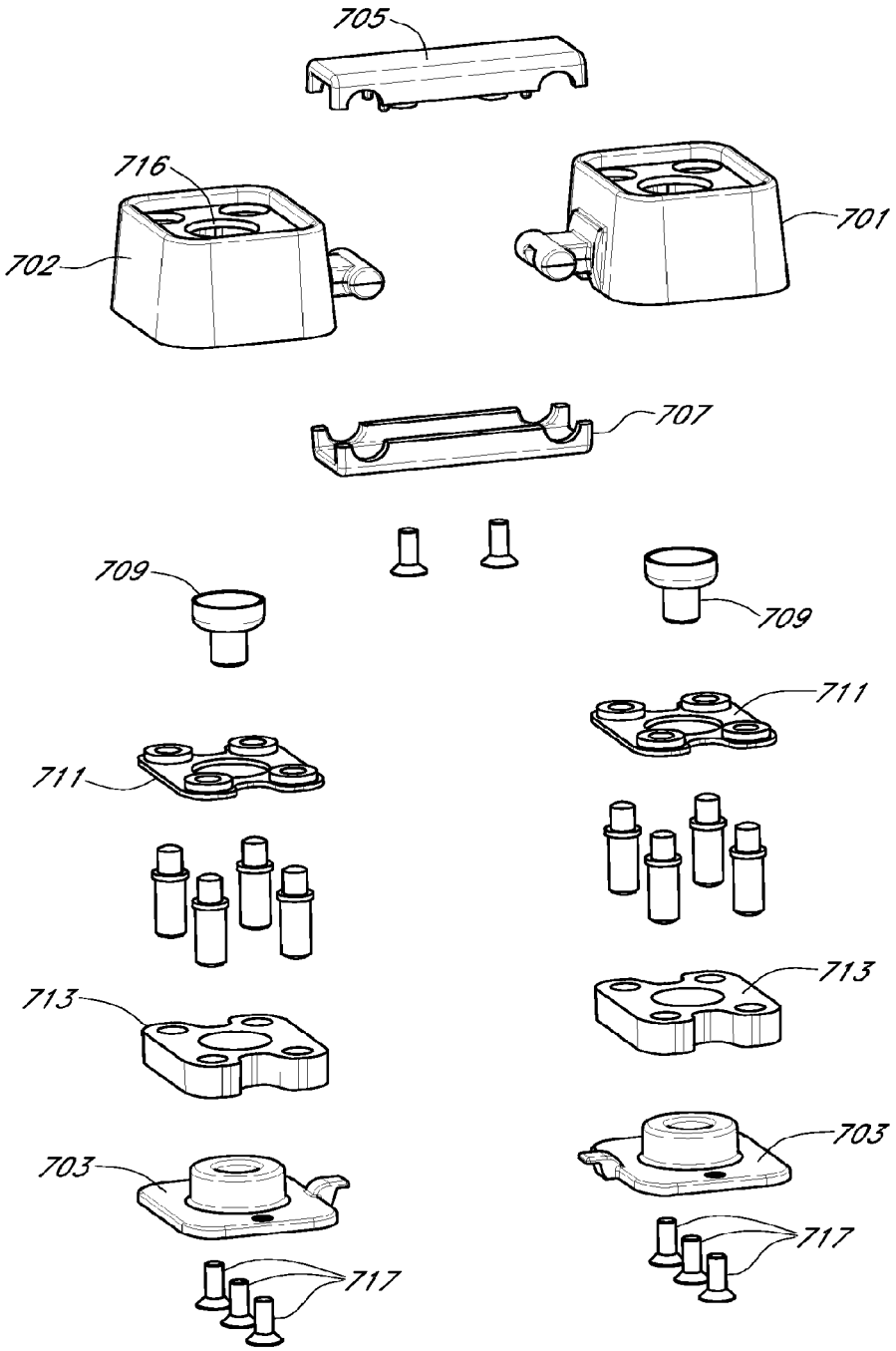
FIG. 7 is a compound assembly of a footswitch controller.
Figure 7B:
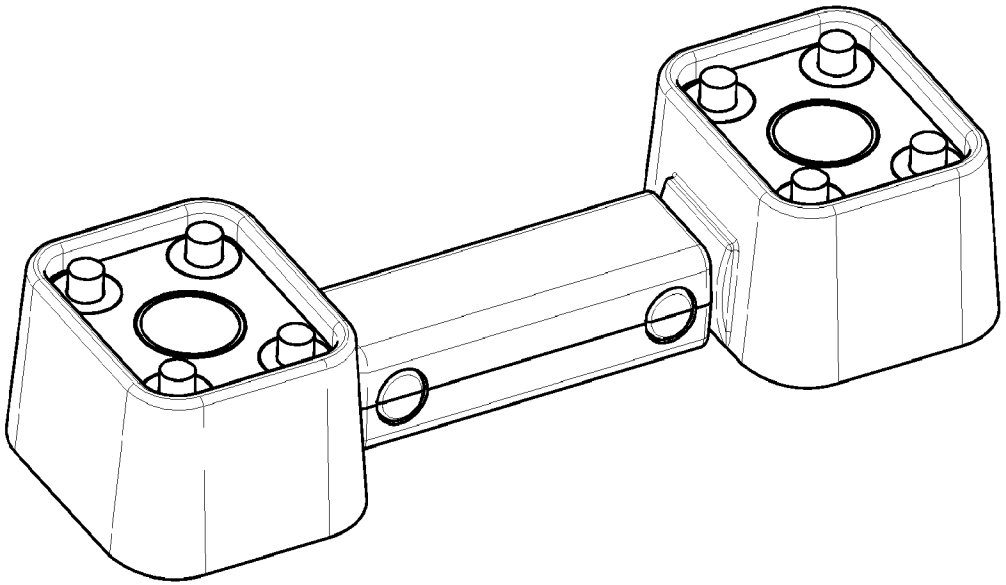
Figure 7C:
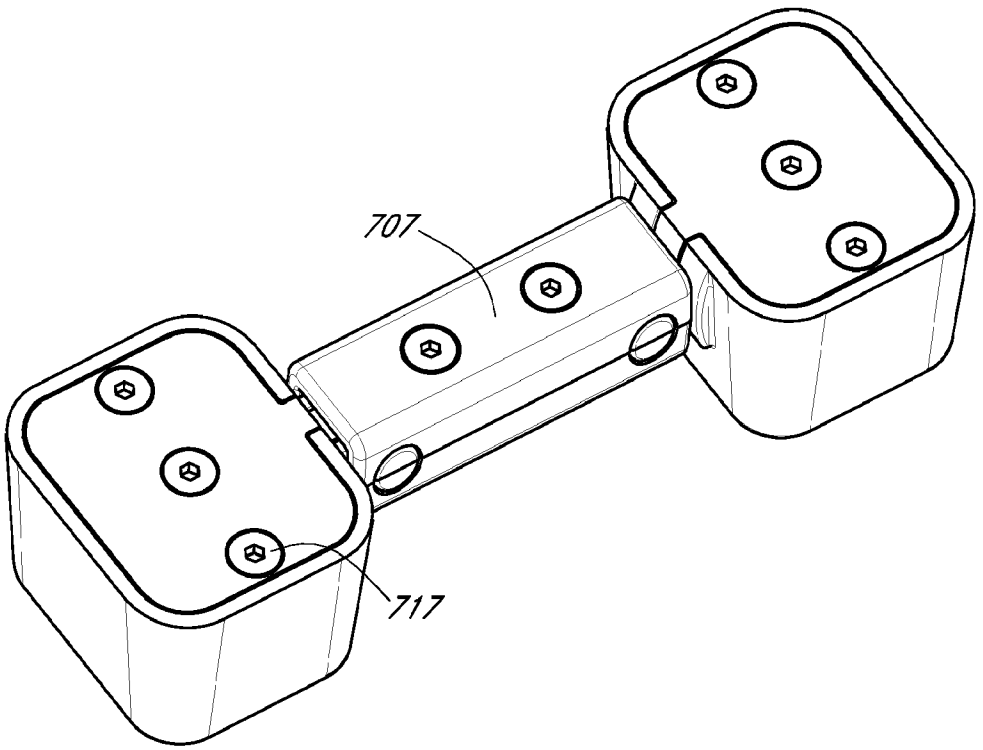

Compound assembly 116, such as the embodiment illustrated in FIG. 7, connects footswitch controllers both mechanically, which allows for large pedal board configurations, and by daisy chaining the input signal, such that only a single radio is used which improves wireless performance and saves on power. Although the figures demonstrate continuous controller footswitch controller 106 being paired with number footswitch controller 107, there is no limitation on the type of footswitch controllers that can be connected. Compound assembly 116 comprises compound body 701, compound body cover 703, top 705, bottom 707, at least one magnet 709, guard plate 711, guiding plate 713, contact pin 715, and fastener 717. Fastener 717 connects compound assembly 116 through openings in compound body cover 703. Magnet 709 and at least one contact pin are accessible through openings 716 in compound body 701. In many embodiments, compound assembly 116 is flexible such that compound bodies 701 are not rigidly separated from each other.

Generally, compound body 701 of compound assembly 116 fits into cavity 502 of bottom plate assembly 112. This allows compound assembly to interact with compound PCB 503 through contact pin 715. Magnet 709 of compound assembly keeps compound assembly 116 in place when positioned in cavity 502.

In the continuous controller footswitch controller 106 in FIG. 2, the footswitch effects volume, rotary speaker, octaver, and wah-wah. In many embodiments, switches 411 are illuminated. Display 400 provides user feedback for aspects of the electric stringed musical instrument system. In exemplary embodiments, display 400 demonstrates the charge of battery 613. The charge of battery 613 may be displayed in minutes and in one embodiment is on the upper right side of display 400. Display 400 may also include an indicator that blinks to demonstrate the charge of battery 613. In certain embodiments, the indicator blinks increasingly faster when there is less than ten minutes of charge on battery 613 remaining.

Figure 8:
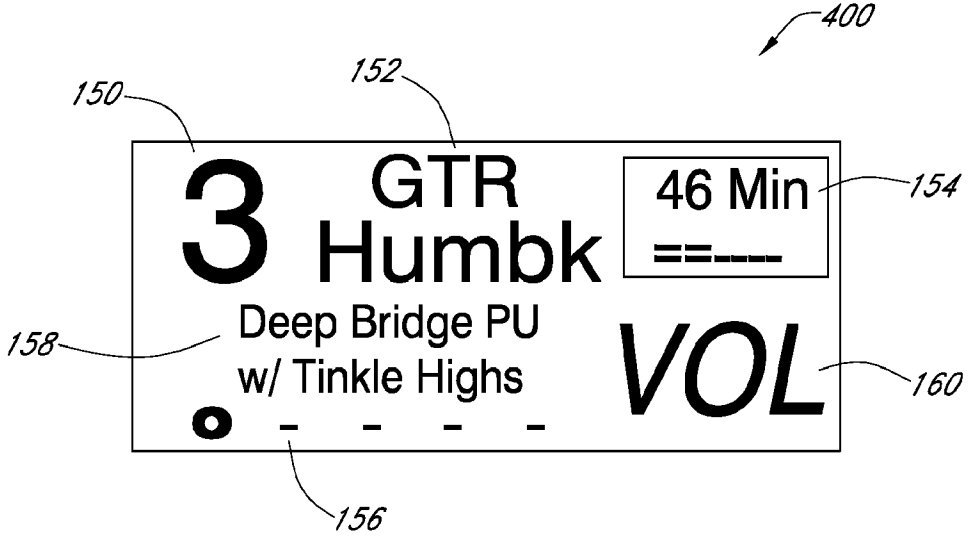
FIG. 8 demonstrates an exemplary display.
Figure 9A:
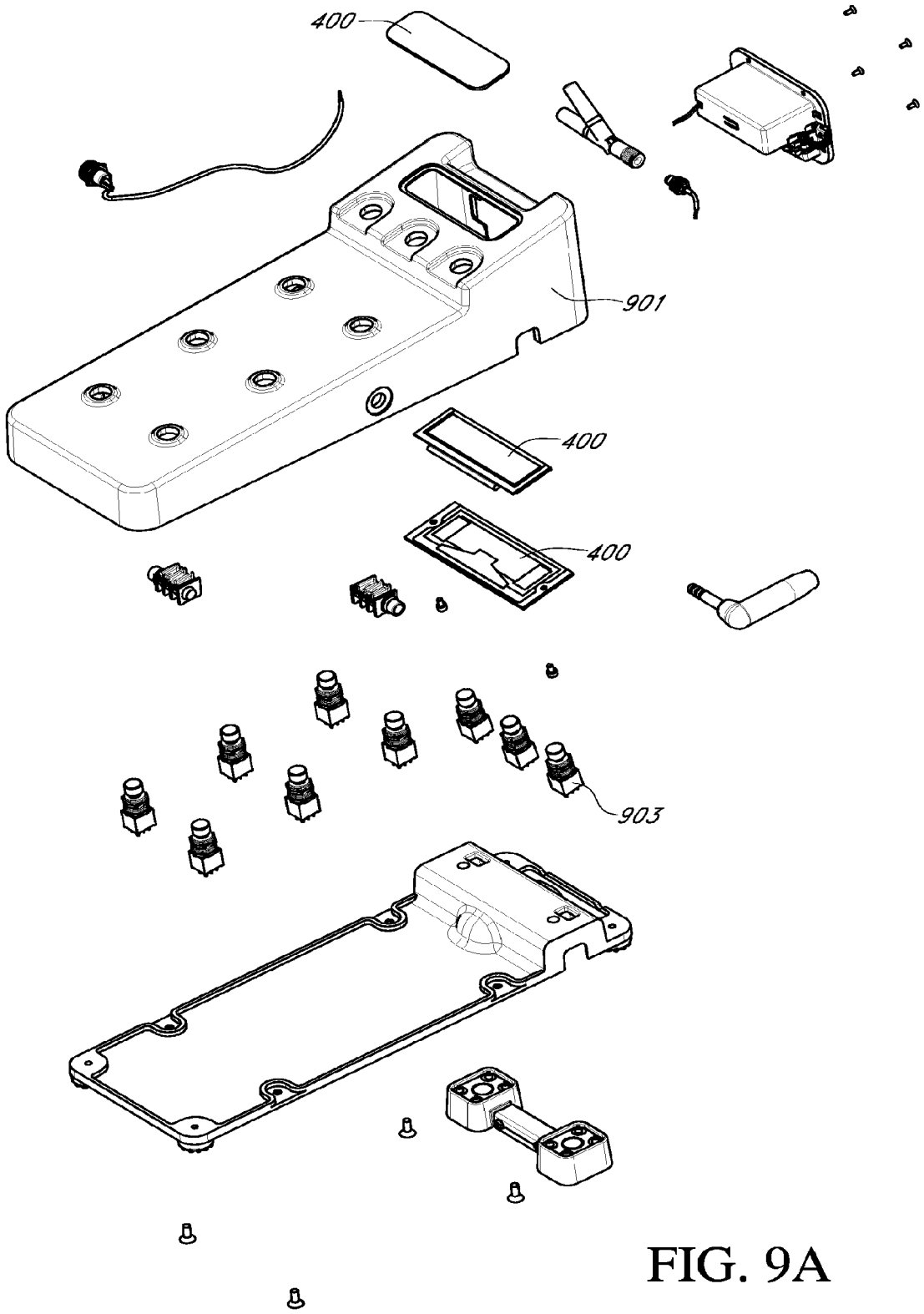
FIG. 9 depicts a number footswitch controller.
Figure 9B:
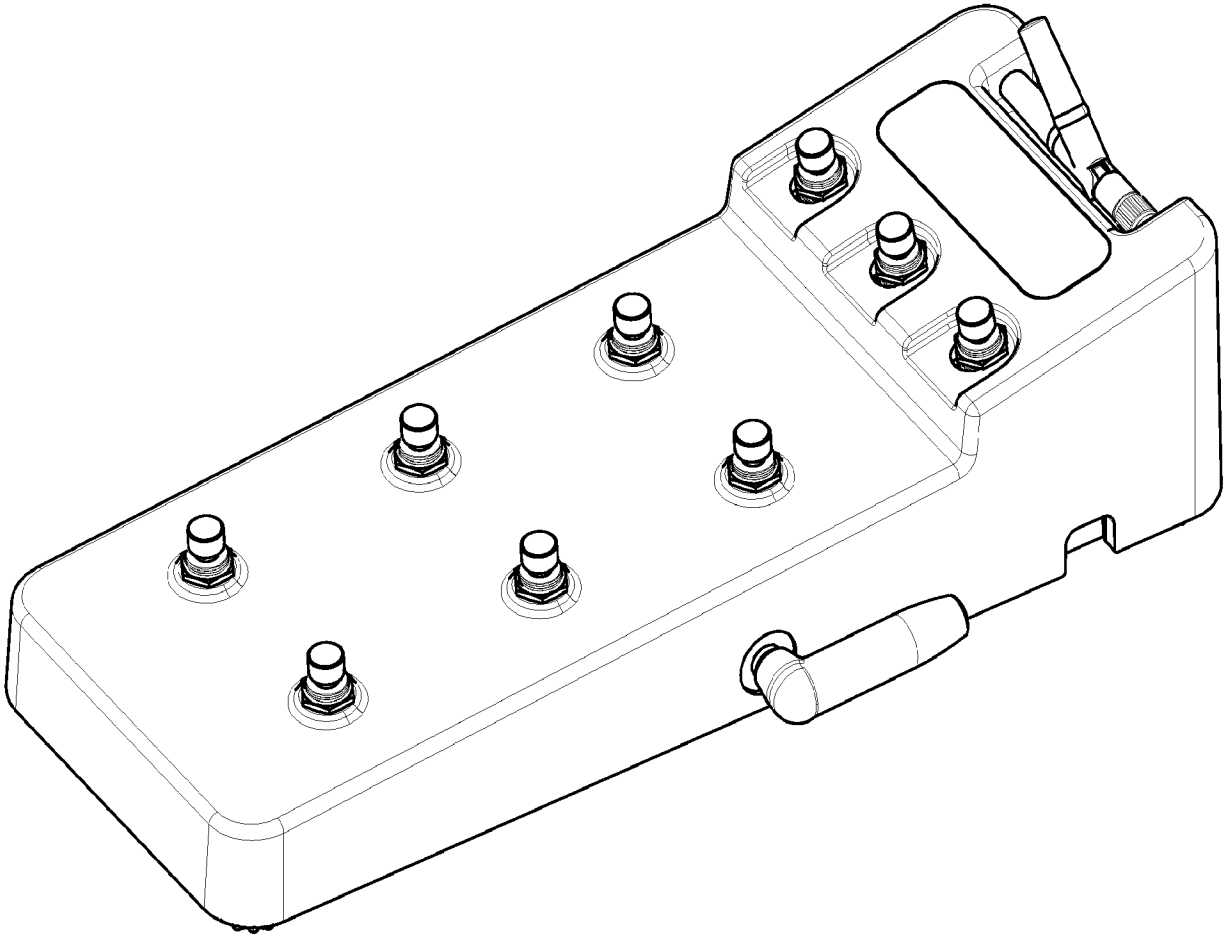
Figure 9C:
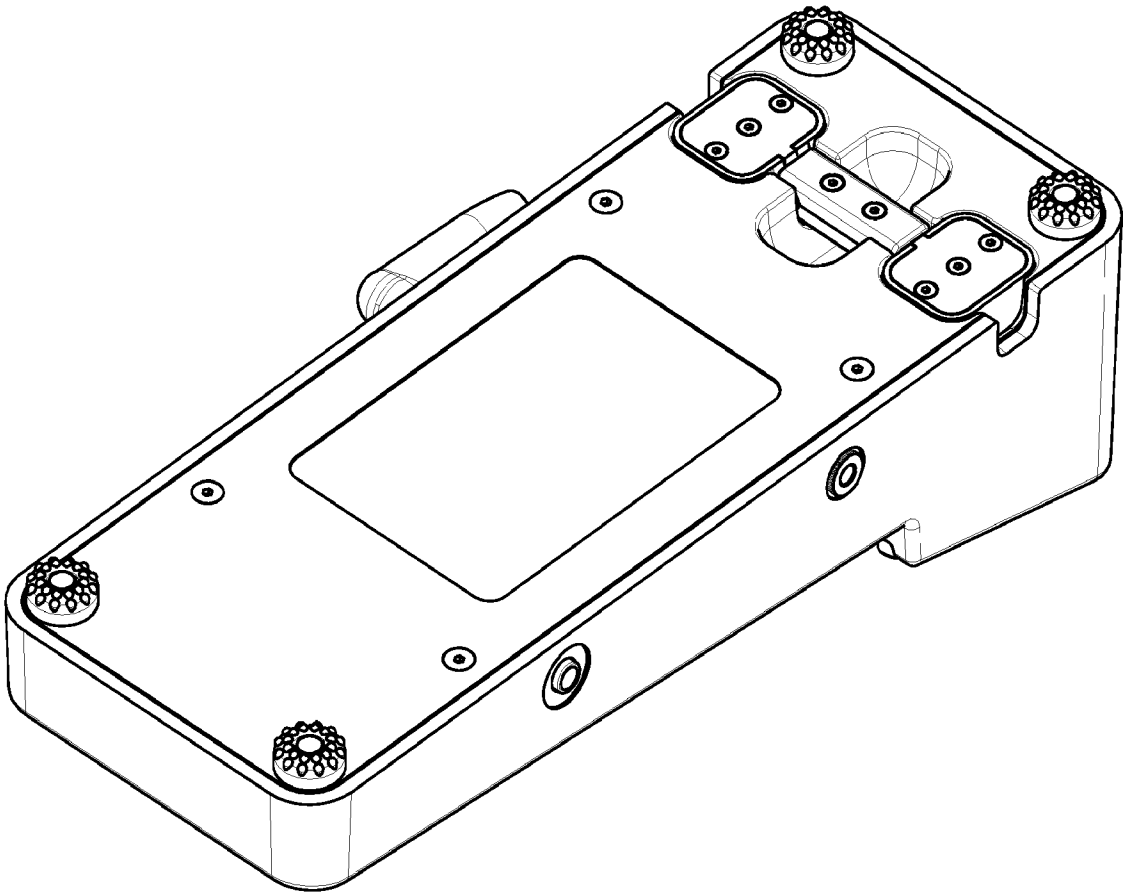
Figure 9D:
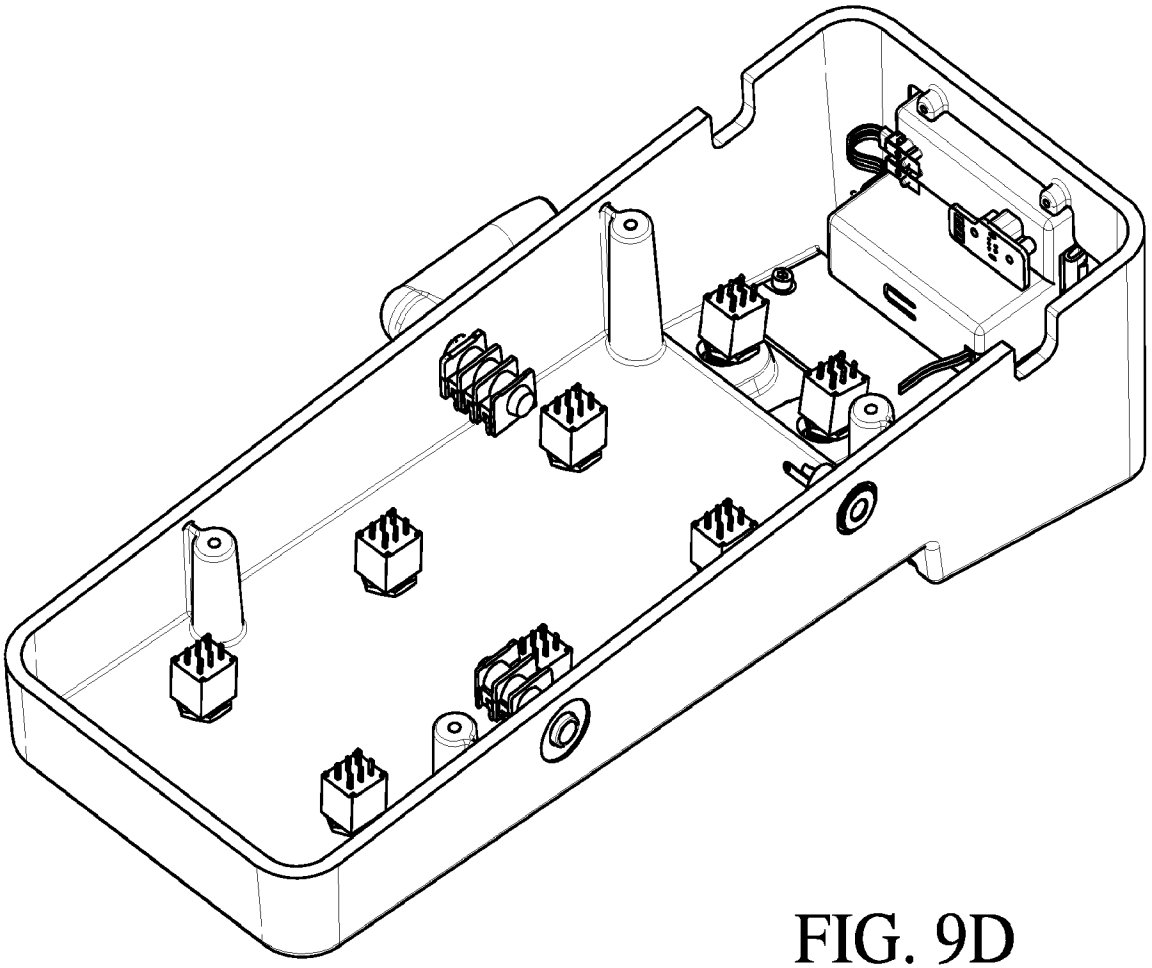
Figure 11:
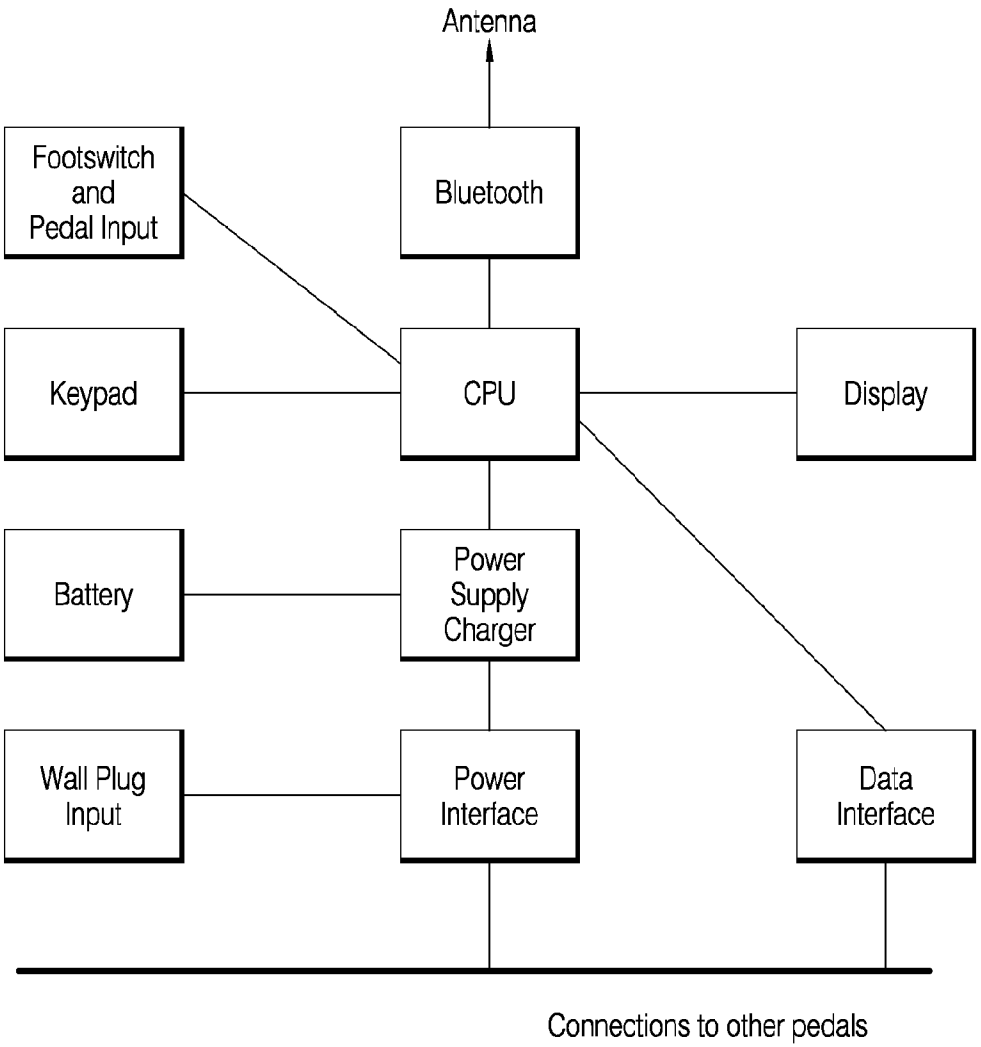
FIG. 11 is a block diagram of the electronics of the footswitch controller in accordance with an illustrative embodiment.

An example of display 400 is depicted in FIG. 8, which shows bank number 150, group name 152, battery charge 154, position of five position switch 156, patch name 158, and footswitch controller function 160. As is understood by the skilled artisan, display 400 in FIG. 11 is exemplary only and different display information/feedback is contemplated. Display 400 is software controllable. In the case of continuous controller footswitch controller, pedal function GG shows which effect is currently engaged, i.e. VOL (volume), ROT (Rotary speaker), OCT (octave), or WAH (Wah-Wah).

An exemplary number footswitch controller 107 is shown in FIG. 9. Number footswitch controller 107 comprises switch board 901 and nine switches 903. The remaining hardware components of number footswitch controller 107, such as display 400, battery pocket assembly 114, and compound assembly 116 are similar to continuous controller footswitch controller 106. A large number of switches 903, which the skilled artisan understands can vary in number, allow a user of number footswitch controller 107 to get to a specific tone very quickly. Furthermore, a large number of switches provides a user with functions which are not accommodated by the electric stringed musical instrument user interface. In primary mode, number footswitch controller 107, allows the user to access sound settings or patches. A table demonstrating exemplary use of number footswitch controller 107 is demonstrated in FIG. 10.

A block diagram of the central processing unit (CPU) of the footswitch controllers is demonstrated in FIG. 11. A signal 180 from a stringed musical instrument is transmitted to the footswitch controller via a wireless signal stream, such as Bluetooth. The wireless signal stream contains program and midi control messages being sent to a footswitch controller paired with the electric stringed musical instrument, wherein the electric stringed musical instrument acts like a master on a wireless channel. Wireless communication allows a user to control the footswitch controllers and the footswitch controllers to operate the guitar circuits or other paired external devices.

The footswitch controllers are controllers only, and do not directly vary the input signal, such as footswitch controllers known in the art. Instead, the footswitch controllers send a wireless signal 182 to the electrical stringed mucial instrument which alters the signal. In an illustrative embodiment, wireless communication signal 182 is a Bluetooth signal that implements a communication protocol based on the Bluetooth protocol to connect with the electric stringed musical instrument 102. Bluetooth is a packet-based protocol with a master-slave structure that partitions a signal to be transmitted into segments. Two signals may be overlaid on each other. In an illustrative embodiment, a first signal includes an audio stream from electric stringed musical instrument 102. The audio stream may be the processed audio signal output from a digital signal processor transmitted from an antenna on the electronic stringed musical instrument. In an illustrative embodiment, the audio stream is sent directly to footswitch controller from the digital signal processor using an integrated interchip Sound (I2S) digital interface connection.

An example second signal includes program and musical instrument digital interface (MIDI) control messages which are sent to the footswitch controllers when they are paired with electric stringed musical instrument, which may act like a master device in a piconet established based on the Bluetooth protocol. Thus, network 114 may include a piconet or other ad hoc network.

Footswitch controllers send Bluetooth packets to electric stringed musical instrument 102, which controls operation of an electronics module by defining effects settings. The electronics module control unit on electric stringed musical instrument 102 receives the effects and sends the effect values to the digital signal processor on the electric stringed musical instrument 102 in a command packet. The control parameters of the electric stringed musical instrument 102 may be displayed on display 400 of footswitch controller. In an illustrative embodiment, the communication of packets between the footswitch controller and electric stringed musical instrument is supported using a time division multiplexing scheme where the footswitch controllers paired with electric stringed musical instrument are synchronized in time.

When footswitch controller is switched on, footswitch controller automatically initiates an inquiry to find electric stringed musical instrument. Electric stringed musical instrument responds with its address. The electric stringed musical instrument may be configured to respond only when placed in a pairing mode with footswitch controller. In an illustrative embodiment, an extended inquiry response (EIR) method is used to read a company identifier and the device address. The device address field is established for both a sending and a receiving device in the established piconet which may form all or a part of network 114. Part of the device address field may be used to define the type of device while a second part of the device address field may be used to define an instance of the device type to allow multiple devices of the same type to be included in network 114.

In an illustrative embodiment, the second part of the address field used to define an instance of the device type may be a random code generated by the device. For example, a three-digit code may be defined using [A-Z][ 0-9] resulting in 46,656 possible codes. As a result, it is unlikely that different devices generate the same code. After receiving the address from the electric stringed musical instrument, a paging procedure is executed to synchronize the footswitch controller with the electric stringed musical instrument. Packet exchange is based on a master clock with the electric stringed musical device transmitting in specified time slots and the footswitch controller transmitting in other assigned time slots. A link is established between footswitch controller and electric stringed musical instrument and information related to the services available from footswitch controller and electric stringed musical instrument is exchanged. Standard network protocols may be used to send and receive data.

In an illustrative embodiment, electric stringed musical instrument is turned on and the three-digit code of electric stringed musical instrument is displayed on a master control knob where the master control knob is switched to a setup function. The footswitch controller is switched on and a setup function is entered to initiate a pairing function between electric stringed musical instrument and the footswitch controller. All devices with the specified company identifier may be listed on a display associated with each footswitch controller of the one or more footswitch controllers. The device name of electric stringed musical instrument may be selected from the display, for example, using up/down buttons to highlight the device name of electric stringed musical instrument and pressing an "Enter" button.

Any aspect or design described herein as "exemplary" is not necessarily to be construed as preferred or advantageous over other aspects or designs. Exemplary embodiments may be implemented as a method, apparatus, or article of manufacture. The word "exemplary" is used herein to mean serving as an example, instance, or illustration.

From the above discussion, one skilled in the art can ascertain the essential characteristics of the invention, and without departing from the spirit and scope thereof, can make various changes and modifications of the embodiments to adapt to various uses and conditions. Thus, various modifications of the embodiments, in addition to those shown and described herein, will be apparent to those skilled in the art from the foregoing description. Such modifications are also intended to fall within the scope of the appended claims.

What is claimed is:

1. A footswitch controller for an electric stringed musical instrument system comprising: a foot pedal assembly, wherein the foot pedal assembly comprises a foot pedal and a liner;

a base assembly connected with the foot pedal assembly, wherein the base assembly comprises a foot pedal base, a display panel, a motor assembly within the base assembly, and at least one foot switch;

a bottom plate assembly connected with the base assembly; and a compound assembly reversibly connected to the bottom plate assembly.

2. The footswitch controller of claim 1 wherein the foot pedal assembly further comprises at least one damper connected with the underside of foot pedal assembly between the foot pedal assembly and top of foot pedal base.

3. The footswitch controller of claim 1 wherein the foot pedal assembly further comprises a silencer connected with the underside of foot pedal assembly between the foot pedal assembly and top of foot pedal base.

4. The footswitch controller of claim 1 wherein the foot pedal assembly further comprises at least one bump stop connected with the underside of foot pedal assembly between the foot pedal assembly and top of foot pedal base.

5. The footswitch controller of claim 1 wherein the foot pedal assembly further comprises at least one opening adapted for receiving a fastener such that the foot pedal can be reversibly connected with the base assembly.

6. The footswitch controller of claim 1 wherein the foot pedal assembly further comprises a projection sleeve, further wherein the projection sleeve is adapted for connection of the foot pedal to the motor.

7. The footswitch controller of claim 1 wherein the base assembly further comprises a display LED and a display LED printed circuit board (PCB), wherein the display panel, the display LED, and display LED printed circuit board comprise a display.

8. The footswitch controller of claim 1 wherein the base assembly further comprises a jack plug integrally connected with the foot pedal base.

9. The footswitch controller of claim 8 wherein the base assembly further comprises an antenna reversibly connected with the antenna connector and an antenna connector connected with the foot pedal base.

10. The footswitch controller of claim 1 wherein the motor assembly comprises a motor, an actuator shaft connected with the motor, a wheel fitted over the actuator shaft, a belt associated with actuator shaft, a potentiometer connected to the wheel, a shaft connected with the potentiometer, an actuator connecting the motor assembly to the foot pedal base, and bearing blocks supporting the motor.

11. The footswitch controller of claim 1 wherein the bottom plate assembly comprises a bottom plate, wherein the bottom plate has a bottom and a top, further wherein the bottom plate defines at least one cavity.

12. The footswitch controller of claim 1 wherein the bottom plate assembly further comprises a compound PCB in the at least one cavity, wherein the compound PCB is held in place by a holding disc and fastener.

13. The footswitch controller of claim 1 further comprising a battery pocket assembly, wherein the battery pocket assembly comprises a battery pocket, a block connector connected with the battery pocket, a block strip protecting the block connector, a mini PCB, a battery contact associated with the battery pocket, a removable cover and a cover tether.

14. The footswitch controller of claim 1 wherein the compound assembly comprises a compound body, further wherein the compound body comprises a compound body cover, a top capable of connecting compound bodies, a bottom associated with the top during connection of compound bodies, at least one magnet within the compound body cover, a guard plate which secures the at least one magnet in the compound body, a guiding plate which secures the guard plate in the contact body, at least one contact pin, and a fastener.

15. The footswitch controller of claim 1 wherein the compound assembly allows a daisy chain of an input signal.

16. The footswitch controller of claim 1 wherein each footswitch controller further comprises a unique identification.

17. The footswitch controller of claim 16 wherein the unique identification of each footswitch controller allows multiple footswitch controllers to be used in a single system, wherein the unique identification further allows the single system to contain footswitch controllers that are mapped to an infinite number of functions.

18. The footswitch controller of claim 1 wherein the display panel provides at least one user feedback for aspects of the electric stringed musical instrument system.

19. A method of varying the audio signal of an electric stringed musical instrument comprising transmitting an audio signal from an electric stringed musical instrument to the footswitch controller of claim 1.

20. A method of pairing a footswitch controller to an electric stringed musical instrument comprising:

(a) automatically initiating an inquiry to find an electric stringed musical instrument by the footswitch controller of claim 1;

(b) transmitting an address from an electric stringed musical instrument to the footswitch controller; and (c) executing a paging procedure to synchronize the footswitch controller with the electric stringed musical instrument.

* * * * *